US006696959B2

(12) United States Patent
Malik et al.

(10) Patent No.: US 6,696,959 B2
(45) Date of Patent: Feb. 24, 2004

(54) BROKEN BAG SENSING FEATURE FOR A METALLIZED INK BAG

(75) Inventors: Craig Malik, Corvallis, OR (US); Rhonda L. Wilson, Monmouth, OR (US); Michael S. Ardito, Lebanon, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/199,215

(22) Filed: Jul. 19, 2002

(65) Prior Publication Data

US 2004/0012497 A1 Jan. 22, 2004

(51) Int. Cl.[7] ..... G08B 21/00
(52) U.S. Cl. ..... 340/605; 340/598; 200/61.05
(58) Field of Search ..... 340/605, 595, 340/598, 592, 593, 603, 568.7, 604; 200/61.05, 61.04, 182, 185, 193, 233; 347/7, 86, 84; 101/335

(56) References Cited

U.S. PATENT DOCUMENTS 4,415,886 A * 11/1983 Kyogoku et al. ..... 340/618
4,551,734 A * 11/1985 Causley et al. ..... 346/140 R
5,329,304 A * 7/1994 Koizumi et al. ..... 347/7
6,175,310 B1 * 1/2001 Gott ..... 340/605
6,220,702 B1 * 4/2001 Nakamura et al. ..... 347/86

* cited by examiner

*Primary Examiner*—Daniel J. Wu
*Assistant Examiner*—Phung Nguyen

(57) ABSTRACT

An ink system is disclosed which includes a broken bag sensing feature for use with conductive ink. The ink system preferably includes an ink containment bag with a metallized layer insulated from the bag interior; a first electrical contact with the metallized layer; a second electrical contact communicating with conductive ink contained within the ink containment bag; an electrical connection between the first and second electrical contacts; and a measurement device for measuring an electrical characteristic between the first and second contacts.

8 Claims, 2 Drawing Sheets

BROKEN BAG SENSING FEATURE FOR A METALLIZED INK BAG

FIELD OF THE INVENTION

The present invention relates generally to the field of ink containers, and more particularly, to broken bag sensing for metallized film ink bag designs.

BACKGROUND OF THE INVENTION

Prior art broken bag detection designs for metallized film ink bags typically have pads routed to the interior of the ink bottle containing the metallized bag, but external to the bag itself. Such pads are intended to short when exposed to conductive ink. The pads in these prior art ink bag detection designs were small and integrated into a flex circuit. However, such broken bag sensor designs typically would only work properly for large leaks. To operate properly, the contact pads in such prior art designs must be exposed to the ink that has leaked. Accordingly, the pads must be positioned in the vicinity of the leak location in order to be effective. In the event of a small leak, or if the supply orientation is disadvantageous, then the break in the bag will not be detected. Non-detected broken bags lead to printer and possibly customer property damage by contaminating the air system with ink. Such leaks could also potentially overflow beyond the capacity of the ink trap in the air system.

SUMMARY OF THE INVENTION

The present invention comprises in one embodiment an ink system including a broken bag sensing circuit for use with a conductive ink, comprising: an ink containment bag with a metallized layer insulated from a bag interior; a first electrical contact with the metallized layer; a second electrical contact communicating with conductive ink contained within the ink containment bag; an electrical connection between the first and second electrical contacts; and a measurement device for measuring an electrical characteristic between the first and second contacts.

In a further embodiment of the present invention, a printer with a broken bag sensing circuit for use with conductive ink is provided, comprising: an ink containment bag with a metallized layer insulated from a bag interior; a first electrical contact with the metallized layer; a second electrical contact communicating with conductive ink contained within the ink containment bag; an electrical connection between the first and second electrical contacts; and a measurement device for measuring an electrical characteristic between the first and second contacts.

In a further embodiment of the present invention, a method is provided for sensing a broken ink bag, comprising: sensing an electrical characteristic of a circuit including a metallized layer in a containment bag which layer is insulated from an interior of the bag and conductive ink in the interior of the containment bag; and generating a signal if the electrical characteristic equals or passes a predetermined threshold value.

DETAILED DESCRIPTION OF THE PRESENT INVENTION

Figure 1:
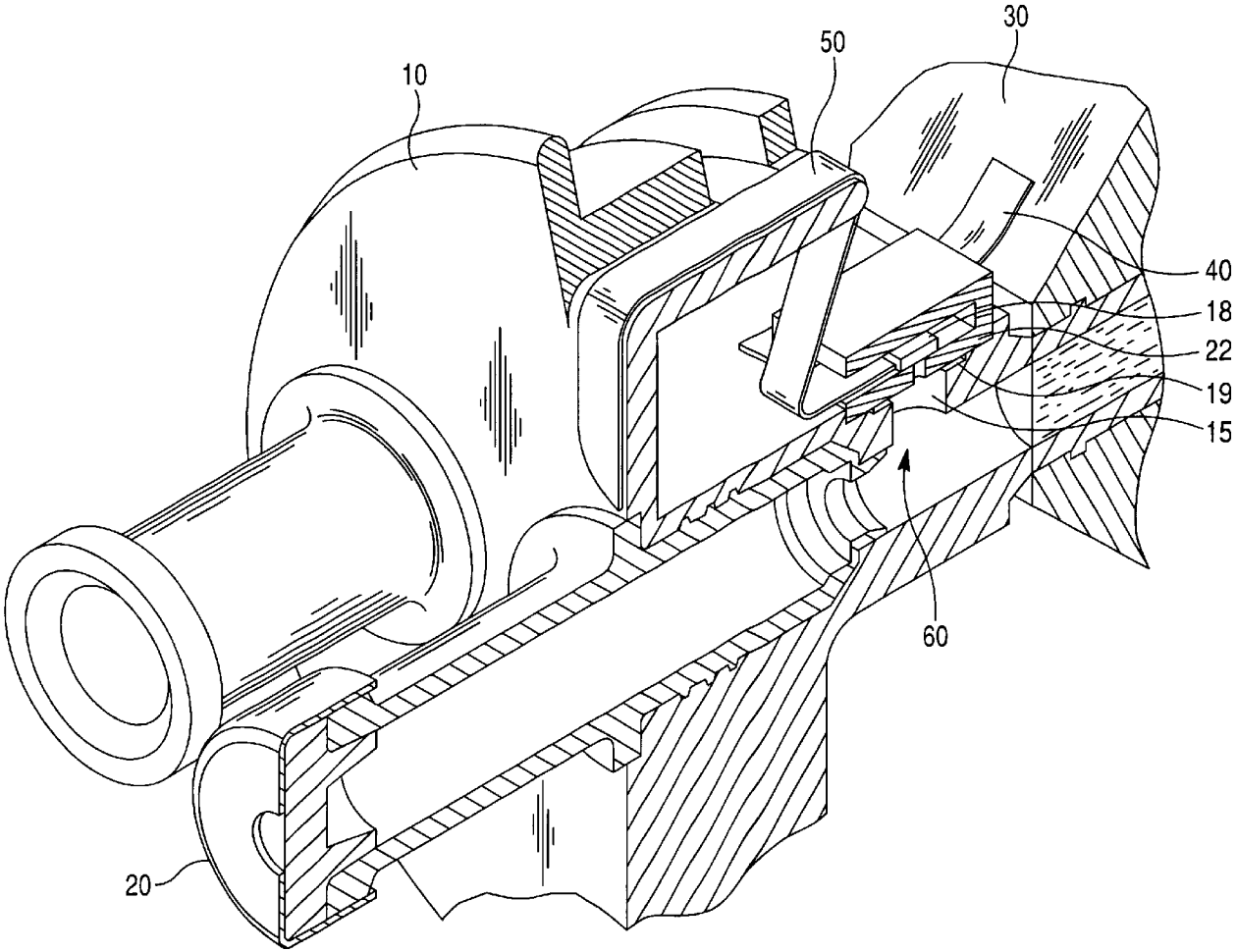
FIG. 1 is a perspective cross section view of one exemplary embodiment of an ink dispensing design and metallized bag system consistent with the present invention.

An exemplary embodiment of the present invention is shown in FIG. 1. The embodiment is an illustration of a large format ink supply comprising a hardened shell such as a plastic shell for example with a metallized bag disposed therein. Referring to FIG. 1, the upper portion of a hard ink supply shell 10 is shown. This upper portion of the hard shell 10 includes a communicating channel 20 for ink to be drawn therethrough from a metallized bag 30. As is well known for such metallized bags, the bag has an inner layer which is nonconductive and at least one additional layer there around which is conductive.

An electrical circuit is created by making a first electrical contact 40 with the metallized layer of the ink containment bag 30. By way of example but not by way of limitation, the electrical contact 40 to the metallized layer in the bag 30 may be obtained by exposing a portion of the metallized layer during the bag manufacturing process and then connecting a tab of a flex circuit 50 to the exposed region. This connection of the tab of the flex circuit may be accomplished using a variety of different methods including conductive adhesive or a conductive mechanical fastener such as a staple.

A second contact 60 is made via a communication to the conductive ink in the interior of the bag 30. In an exemplary embodiment of the invention, this second contact 60 is shown in FIG. 1 as being made by a contact attached to a pressure ink level sense (PILS) module stiffener 22 of a container. As can be seen from the figure, the module stiffener 22 has contact with the conductive ink via a channel 15 and a side hole in the module stiffener. Note that the manufacturing process is designed to ensure that there is no air in the bag so that the ink invades every orifice of the bag including the channel 15 and the side hole. Also note that the second contact could be made using a variety of other techniques and structures and the present invention is not limited to any one particular means for making contact to the ink. As another example, contact could be made to the ink via a separate contact point or added channel on an ink level sensor (silicon die) 18 or via an o-ring 19 below the module stiffener. As an alternative design, ceramics can be made with conductive pathways formed therein (multi-layer ceramic) to which the flex circuit may be wire bonded. As a further alternative, the assembly could be designed such that the mounting screw contacts the ink, and contact material could be exposed on the flex circuit where the screw seats, making an electrical connection from the flex circuit to the ink via the mounting screw. A variety of other contact methods may be used to implement this second contact.

Figure 2:
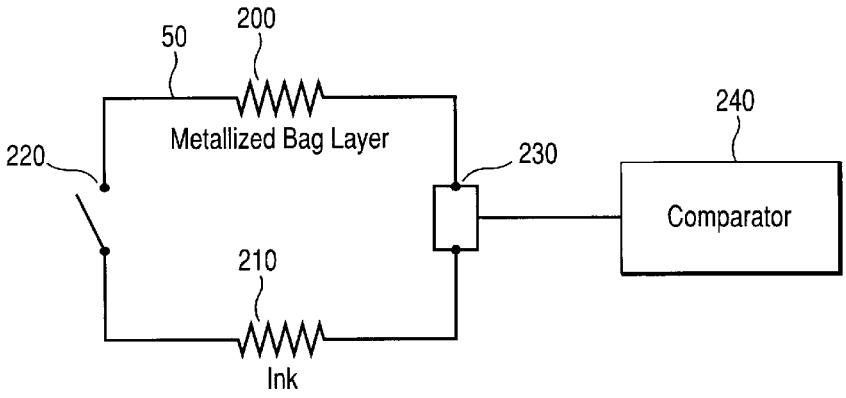
FIG. 2 is a schematic circuit diagram of the exemplary embodiment shown in FIG. 1.

FIG. 2 is a representation of the electrical circuit in accordance with the present invention. The resistor 200 represents the metallized bag layer of the bag 30. The resistor 210 represents the resistance of the conductive ink. The switch 220, when closed, represents a leak. A measurement device 230 is connected to the circuit. This connection may be implemented by extending the flex circuit 50 to a measurement device 230 for measuring an electrical characteristic of the circuit comprising the first and second contacts. In one embodiment of the present invention, the flex circuit 50 may be routed to an electrical interconnect area (not shown), which may be a bus for example, with the bus connecting to the measurement device 230. In a further embodiment of the present invention, a comparator 240 in printer or other convenient device may be connected in a serial or parallel connection to the measurement device 230 in order to compare the electrical characteristic of the circuit to a threshold. The measurement device 230 would test the circuit for continuity and thereby determine if the bag is intact. In one embodiment of the invention, the electrical characteristic being tested may be resistance and the measurement device 230 may be an ohmmeter.

A determination of when a bag is broken can be made in one example embodiment by setting a predetermined threshold for resistance in the comparator 240. When the measured resistance of the electrical circuit equals or drops below this predetermined resistance threshold, then a signal may be generated by the comparator 240 to indicate a broken bag status. This signal by way of example but not by way of limitation, may set a flag, or may trigger a broken bag icon or other message on a graphical user interface for the printer or other network device, more may make some other convenient indication. Accordingly, in a normal situation the resistance between the first and second electrical contacts will be extremely high indicating an open circuit and that the bag is intact. However, if a hole develops in the bag 30, even an extremely small hole, the resistance will drop substantially to a characterizable level.

Figure 3:
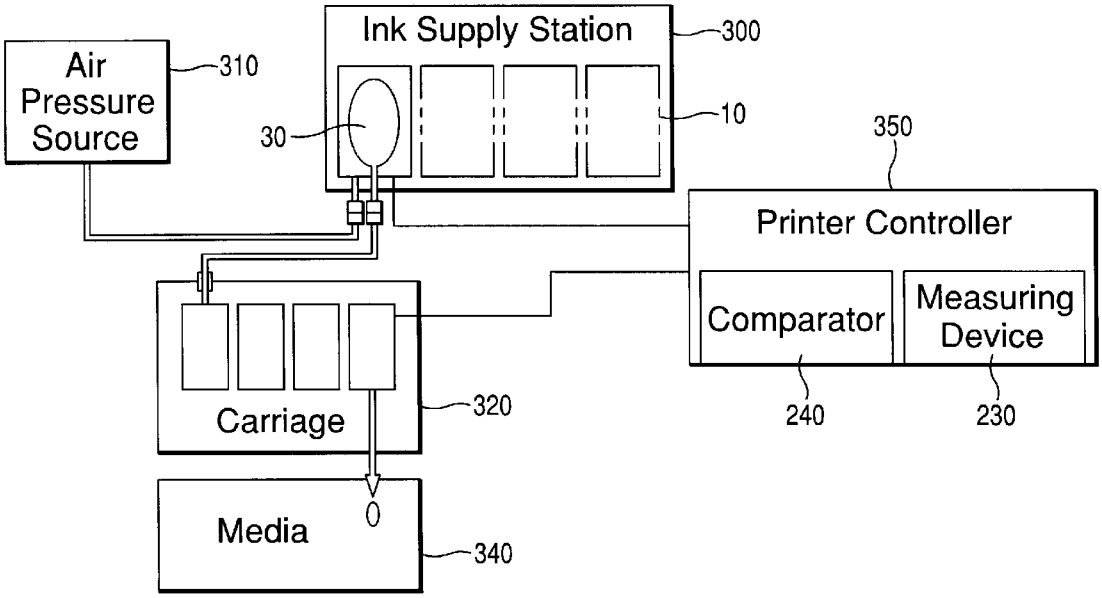
FIG. 3 shows one embodiment of an ink system with a broken bag sensing circuit connected in a printer configuration

FIG. 3 shows one embodiment of an ink system with a broken bag sensing circuit connected in a printer configuration. An ink supply 300 is shown with a plurality of ink supply containers 10, each including a bag 30. An air pressure source 310 is provided, as well as a scanning carriage 320, and a media 340. Control is provided by a printer controller 350 that includes a microprocessor and appropriate firmware, and also includes the measuring device 230 and the comparator 240. The ink system also includes, but does not show in the drawing, a printer driver, CPU, and a monitor.

It should be noted that although the invention has been disclosed using resistance as the electrical characteristic to be measured, the present invention is not limited to such a design and any electrical characteristic may be utilized.

Accordingly, the metallized film broken bag sensor system and method of the embodiments disclosed herein enables the detection of a leak of any size in the bag, and regardless of the orientation of the bag. Thus, the invention is advantageous in preventing potential damage to printers and customer property and also enables designs that had previously been unacceptable due to the supply orientation requirements of the broken bag sensor. In one embodiment, the system and method of the present invention are useful in facilitating the detection of a broken bag before printing begins, thereby minimizing damage.

The foregoing description of embodiments of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An ink system including a broken bag sensing circuit for use with a conductive ink, comprising:

an ink containment bag with a metallized layer insulated from a bag interior;

a first electrical contact with the metallized layer;

a second electrical contact communicating with conductive ink contained within the ink containment bag;

an electrical connection between the first and second electrical contacts; and a measurement device for measuring an electrical characteristic between the first and second contacts.

2. The ink system as defined in claim 1, wherein the electrical characteristic is resistance.

3. The ink system as defined in claim 1, wherein the first contact is formed by contacting a flex circuit to an exposed region of the metallized layer.

4. The ink system as defined in claim 1, wherein the measurement device is in a printer.

5. The ink system as defined in claim 1, further comprising a comparator for receiving from the measurement device a measurement signal indicative of the electrical characteristic and generating a leak signal if the measurement signal equals or passes a predetermined threshold.

6. The ink system as defined in claim 1, wherein the second contact comprises a portion of an ink supply assembly that communicates with the containment bag.

7. A printer with a broken bag sensing circuit for use with conductive ink, comprising:

an ink containment bag with a metallized layer insulated from a bag interior;

a first electrical contact with the metallized layer;

a second electrical contact communicating with conductive ink contained within the ink containment bag;

an electrical connection between the first and second electrical contacts; and a measurement device for measuring an electrical characteristic between the first and second contacts.

8. A method for sensing a broken ink bag, comprising:

sensing an electrical characteristic of a circuit including a metallized layer in a containment bag which layer is insulated from an interior of the bag and conductive ink in the interior of the containment bag; and generating a signal if the electrical characteristic equals or passes a predetermined threshold value.

* * * * *